US005316158A

United States Patent [19]

Dunham et al.

[11] Patent Number: 5,316,158

[45] Date of Patent: May 31, 1994

[54] COUPLER STRUCTURE FOR MODEL TRAINS WITH CENTERING CAVITY AND SURFACES

[75] Inventors: Michael N. Dunham; Lawrence D. Edwards, both of Eagle Point, Oreg.

[73] Assignee: Kadee Quality Products Co., White City, Oreg.

[21] Appl. No.: 9,272

[22] Filed: Jan. 26, 1993

[51] Int. Cl.[5] ..... B61G 3/00

[52] U.S. Cl. ..... 213/75 TC; 213/104

[58] Field of Search ..... 213/20, 74, 75 R, 75 TC, 213/77, 100 R, 104; 105/157.2; 104/DIG. 1

[56] References Cited

U.S. PATENT DOCUMENTS

| | | | |
|---|---|---|---|
| 2,107,024 | 2/1938 | Bonanno | 213/75 TC |
| 2,184,103 | 12/1939 | Rydin | 213/104 |
| 2,574,630 | 11/1951 | Edwards et al. | 213/75 TC |
| 3,397,483 | 8/1968 | Lingard | 105/157.2 |
| 3,605,332 | 9/1971 | Stepek | 213/75 TC |
| 4,512,483 | 4/1985 | Crossley et al. | 213/75 TC |
| 5,090,332 | 2/1992 | Edwards et al. | 105/157.2 |

FOREIGN PATENT DOCUMENTS 4020756 8/1991 Fed. Rep. of Germany ... 213/75 TC

OTHER PUBLICATIONS

*A Walthers Catalog & Reference Manual*, 1987, pp. 138, 144 and 147–149.

*Primary Examiner*—Douglas C. Butler
*Assistant Examiner*—S. Joseph Morano
*Attorney, Agent, or Firm*—Kolisch, Hartwell, Dickinson, McCormack & Heuser

[57] ABSTRACT

An improved coupler structure is intended for use on model railroad rolling stock. The coupler structure includes a coupler having a shank and a joining mechanism for joining to a companion coupler on another piece of rolling stock located at one end of the shank. A centering structure is located adjacent the other end of the shank for maintaining the coupler in an axially aligned condition with the rolling stock body axis. The centering structure includes a centering cavity formed in the shank other end and a centering mount attached to the rolling stock body.

17 Claims, 8 Drawing Sheets

COUPLER STRUCTURE FOR MODEL TRAINS WITH CENTERING CAVITY AND SURFACES

BACKGROUND OF THE INVENTION

This invention relates to model railroad rolling stock and specifically to a self monitoring coupler structure and to such a self-centering coupler structure which provides increased angular motion.

Model railroads, as the name suggests, are scale models of prototype railroads. Persons who use model railroads are model railroaders. A complete model railroad includes a track layout, a power source which is usually electric, non-powered rolling stock, and at least one powered engine, or powered rolling stock. The layout has defined borders inside of which model railroad track is arranged as desired. Since model railroads are often found in private houses, the layouts are often quite small. Layouts often incorporate short radius curves because short radius curves allow more complicated layouts to be squeezed into smaller spaces. The model rolling stock is modelled on prototype railroad rolling stock, and include trucks that both roll on the track and are rotatably attached to the bottom of the body of the rolling stock. Each end of the rolling stock is equipped with a coupler structure. Coupler structures allow a unit of rolling stock to be connected to an adjacent unit of rolling stock on the same track. By connecting a number of rolling stock units in series, and placing a motor equipped rolling stock at one end of the series, a model train is formed.

Coupler structures for use on model railroad rolling stock are designed to appear as realistic as possible. Prototype coupler structures include a knuckle, a shank and a receiver. Thus, model railroad coupler structures also include a knuckle, a shank, and a receiver.

The knuckle is designed to mate with similarly shaped knuckles, thereby providing the coupling effect necessary to link two units of rolling stock together. The shank is attached to the knuckle to form a coupler mechanism. The length of the shank provides the necessary spacing between the rolling stock. The shank usually is pivoted about a vertical axis allowing the two units of rolling stock to move laterally relative to each other without exerting excessive, derailing lateral forces through the coupled knuckles. The receiver is attached to the rolling stock body, and is designed to retain the shank to the rolling stock body but allow limited angular motion of the shank relative to the rolling stock. The receiver usually includes an enclosed structure with walls, an opening through which the shank is inserted, a retainer to attach the shank to the receiver, and a centering spring to center the shank relative to the receiver. Thus, when two units of rolling stock are placed on a straight section of track, the knuckles of each rolling stock will be aligned with each other so that when the rolling stock are forced together the knuckles mate. In this situation, the centerline, or longitudinal axis, of the rolling stock overlays the centerline of the track.

The coupler structure just described works well on prototype and on most model railroads, but has limitations on some model railroads. Long rolling stock units, generally in excess of 60 feet in length, require large radius curves because when a rolling stock unit passes through a curve, the ends of the rolling stock, beyond the truck axis of rotation, shifts outboard of the center line of the track. This is because the pivot points of the rolling stock trucks are located some distance from the end of the rolling stock. As the length of rolling stock increases, the distance between the end of the unit and the truck pivot point increases, causing the rolling stock centerline at the end of the rolling stock to shift further away from the center line of the track. Because the coupler mechanism has limited angular motion relative to the rolling stock body, long rolling stock units passing through short radius curves will experience lateral forces, which are induced by the coupler, which will result in the derailment of the rolling stock. The coupler mechanism reaches the limit of its angular motion before the end of the rolling stock extends far enough to accommodate the curve. Derailment may also occur on short radius S-curves as well. Thus long rolling stock units are only used on large radius curves in prototype railroads.

In model railroads, however, it is frequently desired to use long rolling stock units on short radius curves because model railroad layouts are commonly constructed with short radius curves in order to put as much track as possible on a layout to make train operation more interesting. While the model railroader could accommodate the small radius curves by only using short rolling stock on the layout, most model railroaders prefer to be able to use a wide variety of rolling stock. Thus it is required that long rolling stock units which are intended for use on such layouts be equipped with coupler structures that permit greater angular motion than the prototype coupler structure.

One known technique for providing the added angular motion necessary to use long rolling stock on short radius curves is to take the coupler mechanism referred to above, including the knuckle, shank and receiver, and attach it to a coupler subframe which is mounted concentrically with the vertical axis of the truck, and pivots about the attachment point for the truck. This technique, however, requires that the coupler subframe be precisely sized to match the length of the rolling stock unit because the distance from the end of the rolling stock to the attachment point for the trucks varies. It also is designed to match the geometry of only a particular manufacturer's trucks, thus limiting the usefulness of such technique because of the numerous parameters involved in various styles and designs of rolling stock trucks. Such a coupler mechanism mounting scheme frequently results in derailment-producing lateral forces when a train which includes rolling stock units so equipped negotiates a small radius curve, an S-curve, or travels over a turnout. The problem is aggravated when such a train is backed though such maneuvers. In addition, such mechanisms are unacceptable to serious model railroaders because they are not prototypical, nor do they appear to be prototypical.

An object of the invention is to provide a coupler structure having an increased angular motion for use on model railroad rolling stock.

Another object of the invention is to provide a coupler structure that may be readily attached to the body of model railroad rolling stock unit.

Another object of the invention is to provide a coupler structure that attaches to the body of model railroad rolling stock regardless of variations in length, design, style, or trucks used thereon.

Another object of the invention is to provide a self-centering coupler structure which is easily retrofit onto existing model railroad rolling stock units.

Another object of the invention is to provide a coupler structure with increased angular motion that is realistic in appearance.

A further object of the invention is to provide an improved coupler structure for use on model railroad rolling stock that includes a coupler mechanism attached to a coupler mount, and which fastens the coupler mount to the body of the rolling stock.

Yet another object of the invention is to provide a coupler structure having improved performance for backing long rolling stock units through small-radius curves.

The improved coupler structure of the invention is intended for use on model railroad rolling stock, which rolls on trucks attached thereto, wherein the rolling stock has a body, having an major axis thereto. The coupler structure includes a coupler having a shank and a joining mechanism for joining to a companion coupler on another piece of rolling stock located at one end of the shank. A centering structure is located adjacent the other end of the shank for maintaining said coupler in an axially aligned condition with the body axis. The centering structure includes a centering cavity formed in the shank other end and a centering mount attached to the rolling stock body.

These and other objects and advantages of the invention will be more fully appreciated as the description which follows is read with the drawings.

DETAILED DESCRIPTION OF THE PREFERRED EMBODIMENT

Figure 1:
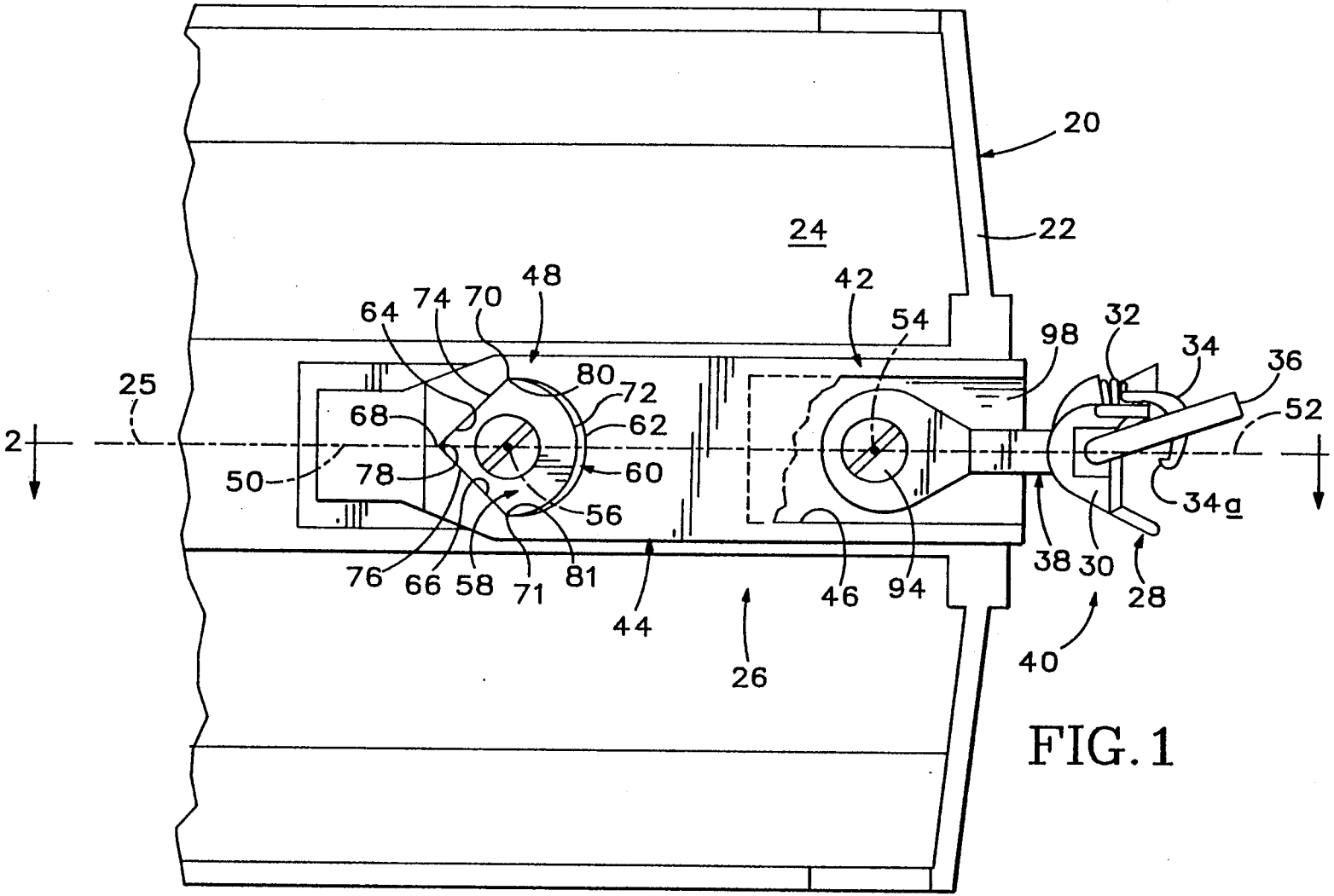
FIG. 1 is an enlarged bottom plan view of the improved coupler structure of the invention, shown attached to a body of a rolling stock unit.

Turning initially to FIG. 1, the underside of a model railroad rolling stock unit is depicted generally at 20. Unit 20 includes a body 22, having an undercarriage 24 therefore and a body axis 25 which extends along the rolling stock unit centerline. A coupler structure constructed according to the instant invention is depicted generally at 26. The coupler structure of the invention includes substructures which are intended to center a coupler knuckle and which are also intended to permit the use of long rolling stock units, generally in excess of sixty scale feet in length, on small radius turns, S-curves, and turnouts, without inducing excessive lateral forces which may result in derailment of rolling stock. To this end, the coupler is provided with a number of components which provide a greater range of lateral movement for the coupler knuckle off the rolling stock unit centerline then is provide by conventional draft box construction.

Structure 26 includes a coupler joining mechanism 28, also referred herein as a coupler knuckle. Joining mechanism 28 is operable with a companion joining mechanism on another unit of rolling stock. Joining mechanism 28 includes a knuckle body 30, a spring 32, an interlock 34, having a hook 34*a* thereon, and an air hose element 36. As depicted in the preferred embodiment, joining mechanism 28 is shown as a Kadee® coupler, the details and operation of which are well known to those of ordinary skill in the model railroading art. It should be appreciated that NMRA hook-and-horn couplers may also be used, as may European style couplers.

Joining mechanism 28 is connected to a shank element 38. Shank element 38 and joining mechanism 28 comprise what is referred to herein as a coupler, or coupler mechanism 40. A first centering structure, depicted generally at 42 is located at the other end of shank element 38, opposite knuckle 28. First centering structure 42 is mounted on a coupler mount 44, also referred to herein as a shank extension, and specifically, is mounted in a receiver 46 thereof. Coupler mount 44 is secured to body 22 by means of a second centering structure 48. As depicted in FIG. 1, a coupler mount axis 50 underlies body axis 25. A longitudinal axis 52 for coupler mechanism 40 is coextensive with coupler mount axis 50 when the coupler structure is in the relaxed condition, or state, depicted in FIG. 1. An object of the centering structure of the invention is to maintain coupler mechanism axis 52, coupler mount axis 50 and body axis 25 in an axially aligned condition.

Figure 2:
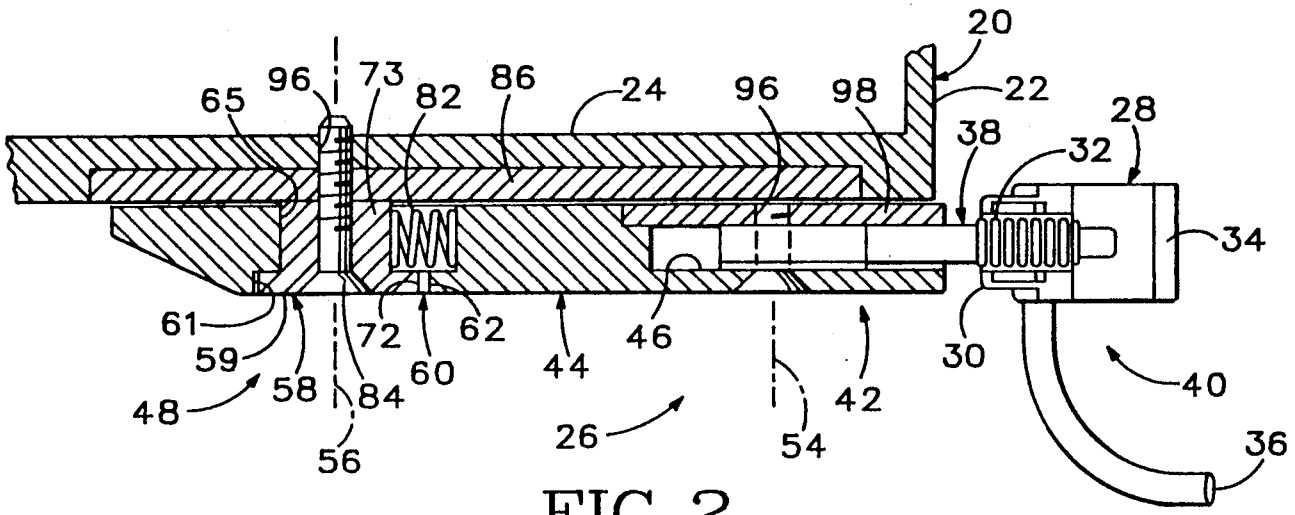
FIG. 2 is a medial sectional elevation of the improved coupler structure of FIG. 1, taken generally through line 2—2.
Figure 4:
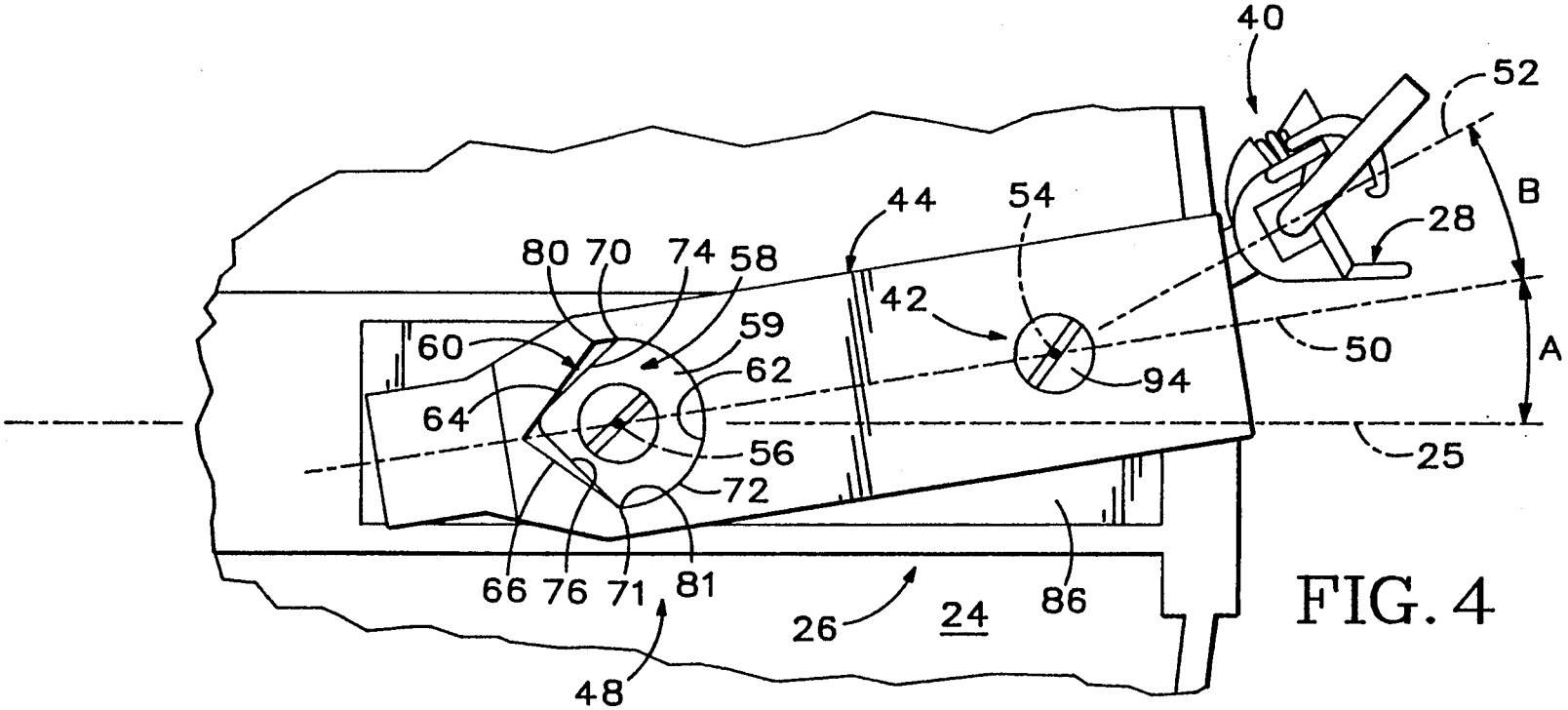
FIG. 4 is a bottom plan view of the improved coupler structure of FIG. 1, and pivoted to the maximum degree of angular motion.

Referring now to FIGS. 1, 2 and 4, first centering structure 42 allows angular motion of coupler mechanism 40 about a first vertical axis 54 while second centering structure 48 allows angular motion of coupler mount 44 about a second vertical axis 56, wherein the first and second vertical axes are spaced apart from one another. The centering structures are also operable to limit angular motion, in order to maintain minimum spacing between the corners of adjacent rolling stock units.

Figure 3:
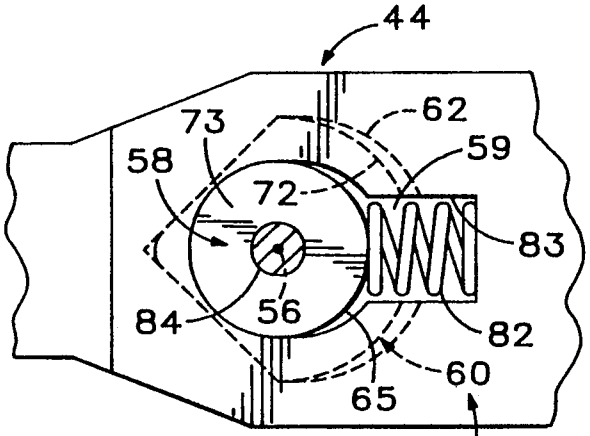
FIG. 3 is an enlarged, fragmental top plan view of a portion of a centering structure of the invention.

The centering structure will be further described. Two embodiments of the centering structure are depicted herein. Referring now to FIGS. 1, 2 and 3, second centering structure 48 includes a centering mount 58, having a flange 59 thereon, and a centering cavity 60, which cavity is formed in coupler mount 44. The centering mounts and centering cavities have substantially conformal plural working surfaces about their outer perimeters.

Centering cavity 60 includes a substantially dome-capped triangular portion or structure 61, resembling an ice-cream cone, which is formed as a recess in coupler mount 44 and includes an arcuate working surface 62 and a pair of rectilinear working surfaces 64, 66. The rectilinear working surfaces are of substantially equal length and join at an angle 68 and intersect the arcuate, or curvilinear surface, at intersection points, 70, 71, respectfully. Cavity 60 includes a substantially cylindrical portion 65, which is contiguous with structure 61 and extends upwardly through coupler mount 44.

Centering mount flange 59 has a similar ice-cream cone-shape and includes an arcuate or curvilinear working surface 72, rectilinear sides 74, 76, also referred to herein as first and second straight sides, respectively, which meet an angle 78, which is rounded off for purposes which will be explained later herein, also referred to herein as a centering point, and also includes intersection or fulcrum points 80, 81, which are laterally spaced from one another, also referred to herein respectively as first pivot point and second pivot point. A post portion 73 of centering mount 58 extends upwardly from flange 59 into cylindrical portion 65. Flange 58 is substantially conformal to centering cavity structure 61.

A biasing mechanism 82, which, in the preferred embodiment, is a coil spring, is provided to relatively bias centering mount 58 within centering cavity 60. Spring 82 is carried in a spring-receiving notch 83, which is formed in the wall of cylindrical portion 65. In this respect, the centering mount and the centering cavity are relatively floating structures. Put another way, ice-cream cone-shaped centering mount 58 floats within centering cavity 60. Biasing mechanism 82 forces the rectilinear surfaces of the centering mount against those of the centering cavity, which maintains, in this instance, coupler mount 44 and axial alignment with body 22.

In the preferred embodiment, and now referring to FIG. 2, centering mount 58 is secured to body undercarriage 24 by means of a fastener 84, which may take the form of a screw or a nut-and-bolt combination. Centering mount post 73 is sized to provide a small gap between undercarriage 24 and coupler mount 44, to allow free swinging of coupler mount 44 relative to undercarriage 24. In some instances, it may be desirable to install a coupler mounting plate 86 in undercarriage 24 in order to provide a smooth, flat surface for coupler mount 44 to rotate under. Otherwise, coupler mount 44 may be mounted directly on undercarriage 24.

Figure 5:
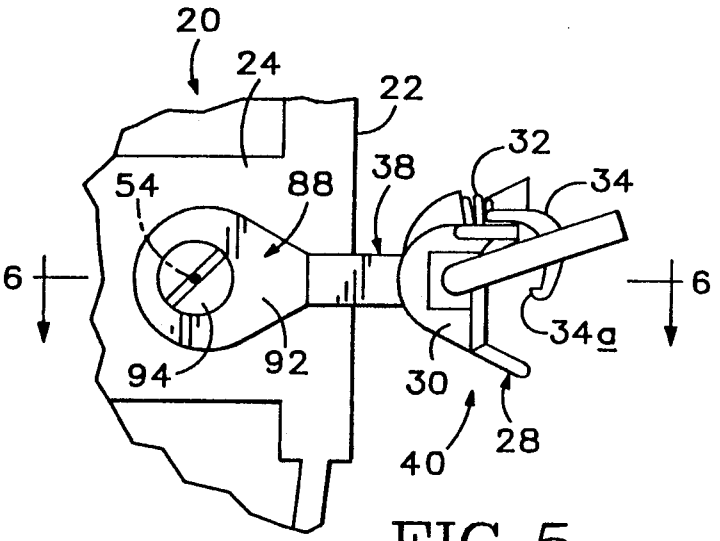
FIG. 5 is an enlarged bottom plan view of an improved coupler mechanism of the invention, shown attached to a body of a rolling stock unit.
Figure 6:
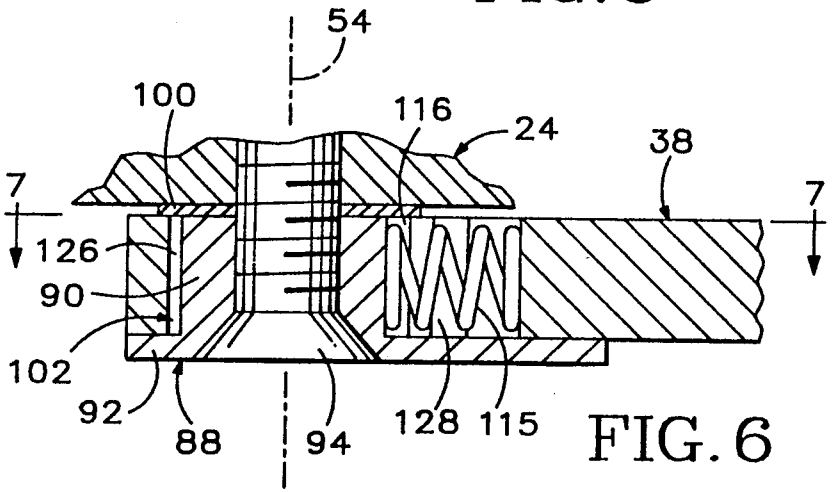
FIG. 6 is an enlarged medial sectional elevation of the improved coupler mechanism of FIG. 5, taken generally through line 6—6.
Figure 7:
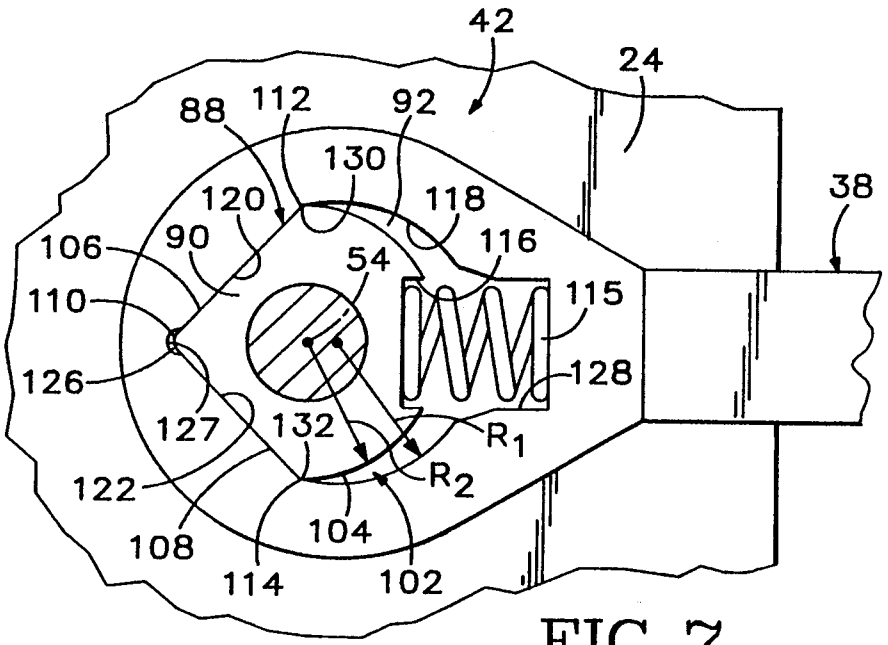
FIG. 7 is an enlarged, fragmental top plan view of a portion of a centering structure of the coupler of FIG. 5, taken generally along line 7—7 of FIG. 6.

As previously noted, a slightly different form of the centering mechanism is depicted generally at 42. Referring now to FIGS. 1, 5, 6 and 7, centering structure 42 includes a centering mount 88 which has a substantially dome-capped triangular structure 90 formed as part thereof, and a retaining flange 92. Centering mount 88 is secured to coupler mount 44, as shown in FIG. 1, or to undercarriage 24, as shown in FIGS. 5, 6 and 7, by means of a fastener 94, which again, may take the form of a screw, a nut-and-bolt, or in the case of centering mount 44, a machine screw which is received in a tapped-bore 96 in a mounting plate 98, which is secured to centering mount 44. Centering mount 88 may be constructed to provide a spacing between the coupler structure and the rolling stock, or a spacer 100 may be provided to space shank element 38 from the car body or coupler mount in order to provide free swinging thereof.

Centering mount 88, in this embodiment, is a relatively floating structure within a centering cavity 102, which is depicted as being formed in the other end of shank element 38. It should be appreciated that other forms of the centering structure may be used interchangeably for securing coupler mount 44 or a coupler to the structure to which the centering mount is secured.

As in the case of the other embodiment of centering structure, centering mount 88 includes an arcuate working surface 104, rectilinear surfaces 106, 108, which meet at an angle 110, and which include intersection or fulcrum points 112, 114 which are formed at the intersections of rectilinear sides 108, 106, respectfully, with arcuate surface 104. A biasing mechanism, or spring, 115, is provided. Arcuate surface 104 includes a spring-receiving notch 116, which is formed therein.

Centering cavity 102 includes substantially conformal surfaces, including arcuate working surface 118, rectilinear surfaces 120, 122, an angle 124, having a, in this embodiment, semi-circular notch 126 formed at the apex thereof, a spring-receiving notch 128 formed an arcuate surface 118 thereof, and intersection points 130, 132 formed at the intersection of rectilinear surfaces 120, 122, with arcuate working surface 118, respectfully.

With respect to the arcuate working surfaces of the centering mounts and cavities, the arcuate surfaces of the centering mounts are constructed having a radius which is less than that of the arcuate surface of the centering cavity. In the case of couplers which are constructed for HO gauge operation, for instance, the radius of the centering mount $R_1$ has a length of 0.070 inches (0.178 cm) while the radius of the centering cavity, $R_2$, has a length of 0.071 inches (0.180 cm). The center points for $R_1$ and $R_2$ are offset from one another, in the preferred embodiment, by 0.015 inches (0.038 cm).

Referring now to FIG. 4, coupler structure 26 is shown in a fully deflected condition, wherein axis 50 of coupler mount 44 is displaced from body axis 25 by an angle A, and coupler mechanism 40, axis 52 has been displaced from axis 50 by an angle B. In the depicted embodiment, angle A has value of approximately ten degrees, while angle B has a value of approximately twenty degrees, providing for a combined lateral displacement of the coupler mechanism axis 52 of approximately thirty degrees off of body axis 25. Such angles may be varied by changing a number of factors, including the relative sizes of the centering mount and centering cavity, and also by changing the distance between vertical axes 54 and 56.

As the coupler mount or coupler mechanism is deflected off of center line 25, the structure bearing the centering cavity rotates substantially about its respective vertical axes, and specifically pivots on a pivot, or fulcrum point, such as fulcrum 71, until such time as the arcuate working surface on the centering cavity is in substantial contact with the arcuate working surface on the centering mount and lateral swinging movement is thereby limited. Bringing the two arcuate working surfaces into substantial contact with one another compresses the spring which, when the lateral force which has caused the displacement is released, will push the rectilinear surfaces of the mount and cavity into contact with one another, thereby centering the coupler mount-/coupler mechanism with the body axis.

As previous noted, angle 78 is slightly rounded, as is angle 124. Additionally, a rounded notch 126 is provided, all of which serve to lessen the lateral force which is required to initially shift the centering cavity bearing structure out of axial alignment with the centering mount-bearing structure. In most instances, it is unlikely that the coupler structure will swing through the full range of angles A and B. It is most likely that a slight deflection through both ranges of movement will occur as a train negotiates curves of any radius. As will be explained later herein, the structure of the invention greatly facilitates the use of small radius curves on a layout.

When coupler structure 26 is in its relaxed state, as depicted in FIG. 1, all of the relatively moveable pieces are centered relative to axis 25 of body 22. In this condition, springs 82 and 115 force the respective rectilinear sides of the centering mounts and centering cavity together. As lateral forces are applied to knuckle 28, springs 82 and 115 are compressed, allowing lateral displacement of coupler mechanism 40 and coupler mount 44.

It should be appreciated that coupler mount 44 serves two purposes. Initially, prototype railroads do not use such coupler mounts, the couplers are mounted directly in draft boxes which are, in turn, mounted on the car bodies. Realism, and realistic train operation is a high priority goal of model railroaders. Prior art swingable coupler mounts, which pivot at the truck attachment point, do not achieve sufficient realism to satisfy most model railroaders. The provision of mount 44, however, looks most realistic when it is centered, resembling a conventional prototype draft box. Additionally, when mount 44 is axially alignment with body 22, knuckle 28 is centered and will properly align with the knuckle on an adjacent unit of rolling stock, provided, of course, that the two units of rolling stock are on a section of straight track. This provides a primary function of allowing realistic coupling and uncoupling operations when remotely operable couplers, such as Kadee® couplers, are used.

Figure 8:
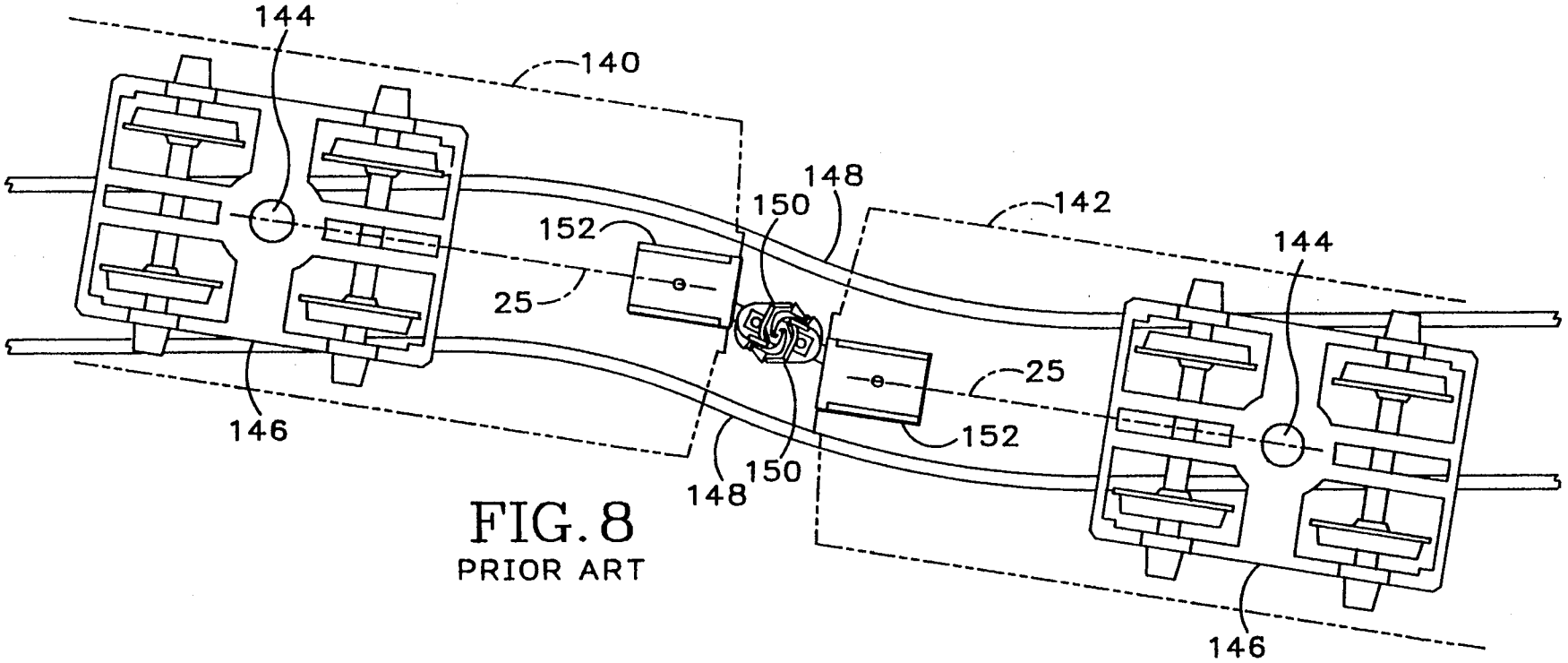
FIG. 8 PRIOR ART
FIG. 8 is a top plan view of two rolling stock units equipped with prior art coupler structures, shown coupled together on a S-curve.
Figure 9:
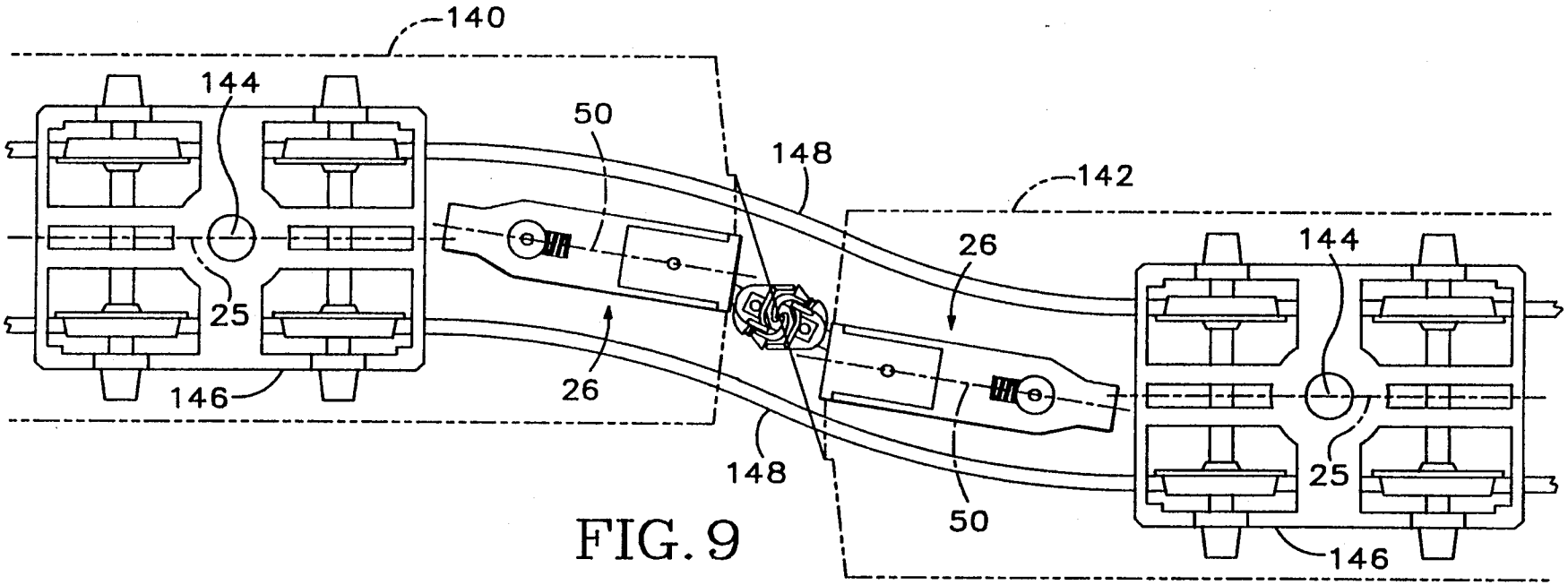
FIG. 9 is a top plan view of the improved coupler structure of the invention shown attached to the body of rolling stock, wherein two rolling stock units are shown coupled together on a S-curve.
Figure 10:
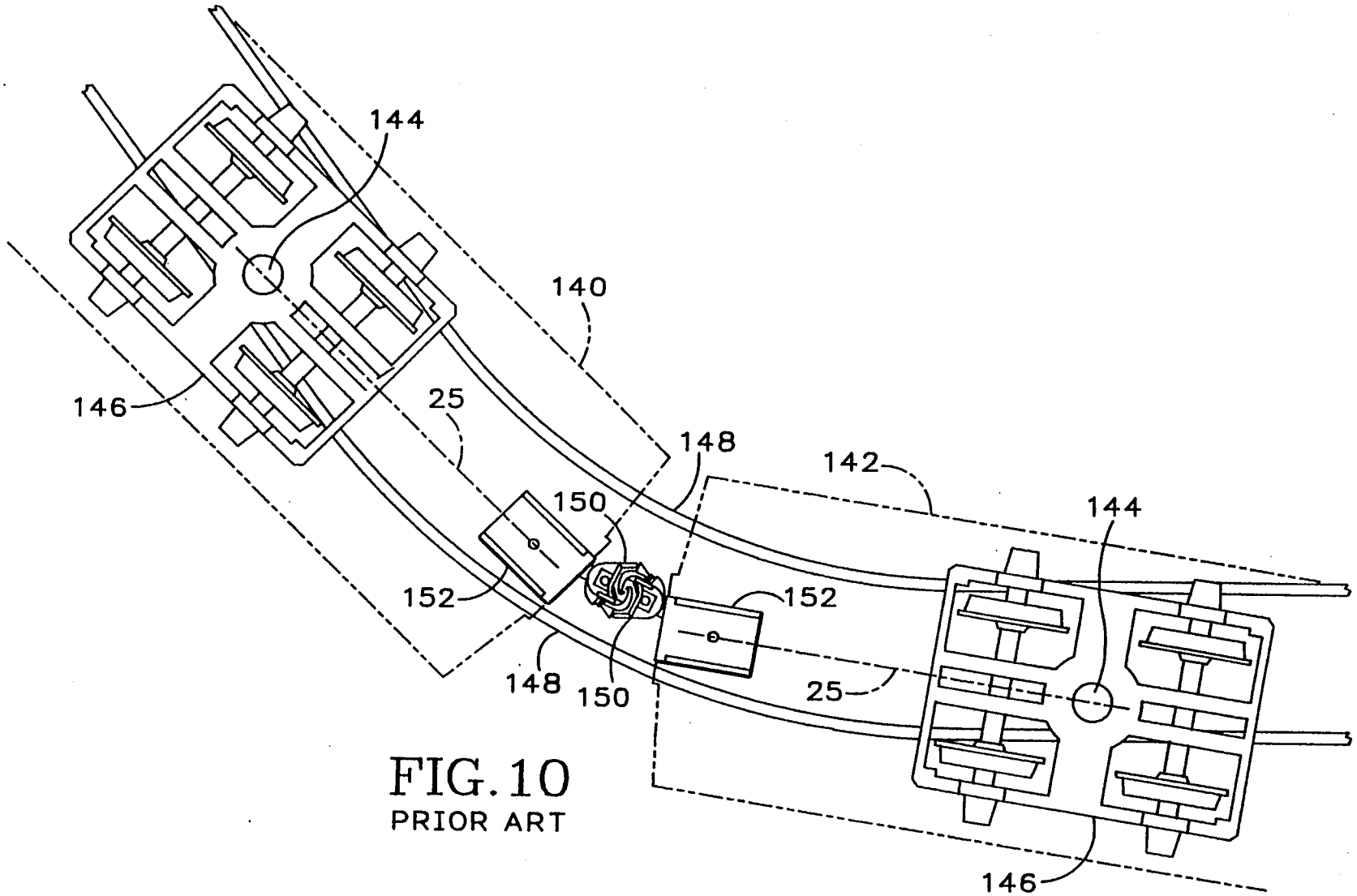
FIG. 10 PRIOR ART
FIG. 10 is a top plan view of two rolling stock equipped with prior art coupler structures, shown coupled together on a short radius curve.
Figure 11:
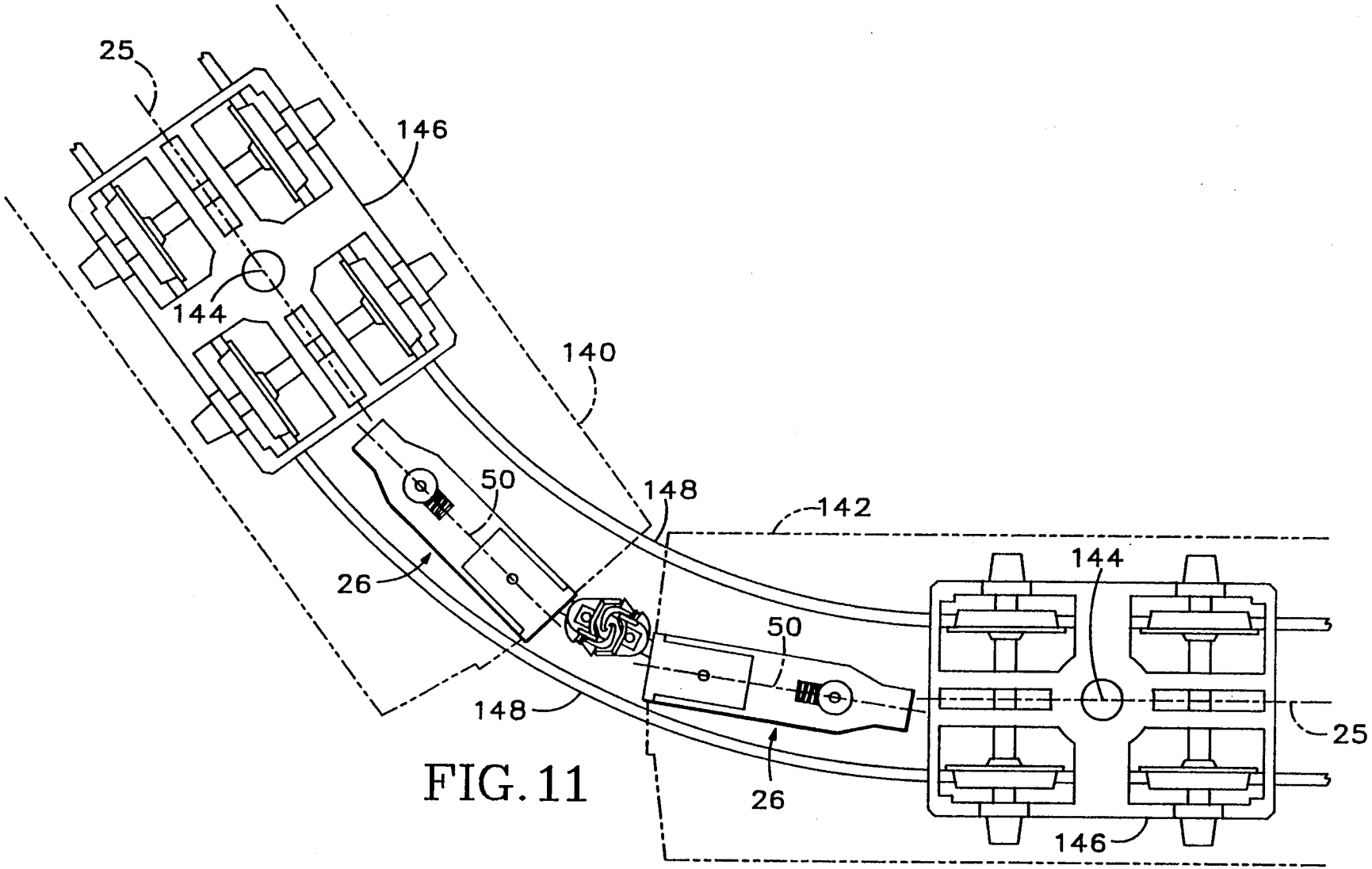
FIG. 11 is a top plan view of the improved coupler structure of the invention shown attached to the body of rolling stock, wherein two rolling stock units are shown coupled together on a short radius curve.

Turning to FIGS. 8-11, rolling stock units 140, 142 are depicted in phantom, with their associated couplers and trucks shown in solid lines. The units each have a longitudinal axis 25, and a truck attachment point 144 about which a truck 146 is rotatably mounted. Units 140, 142 are operable to roll over railroad track 148. Prior Art FIGS. 8 and 10 depict conventional coupler mechanism 150 which are mounted in conventional draft boxes 152. In FIGS. 9 and 11, the rolling stock body is equipped with coupler structure 26 incorporating the improved coupler structure of the present invention. In FIGS. 8 and 9, two rolling stock units are shown coupled together on a S-curve. In FIGS. 10 and 11, two rolling stock units are shown coupled together on a short radius curve.

FIGS. 9 and 11 show rolling stock equipped with the coupler structure of the present invention as the rolling stock passes through short radius curves. Trucks 146 roll on the railroad track and turn about attachment point 144 as the rolling stock passes through curves. The two degrees of freedom of the present invention allow sufficient angular motion of the coupler mechanism to not exert derailing lateral forces on the rolling stock units.

Rolling stock equipped with prior art coupler structures are shown in FIGS. 8 and 10. In both cases the rolling stock unit will derail because the prior art coupler structures, which have reached the maximum limits of possible angular movement, exert a lateral force on the rolling stock units which causes derailment, as shown in the drawings.

The coupler structure disclosed herein, whether provided as new equipment or retrofit onto existing rolling stock, provides for the increased angular motion necessary when long rolling stock is used on short radius curves. The coupler structure is thin enough to not interfere with the trucks of the rolling stock, and it is simple to mount. In addition, it centers the coupler mechanism about the long axis of the rolling stock regardless of the design of the rolling stock body or the trucks attached thereto, and looks realistic.

Although a preferred embodiment of the invention has been disclosed herein, it should be appreciated that variations and modifications may be made thereto without departing from the scope of the invention as defined in the appended claims.

We claim:

1. An improved coupler structure for use on model railroad rolling stock, which rolls on trucks attached thereto, wherein the rolling stock has a body, having a body axis thereon, comprising:

a coupler having a shank;

a joining mechanism, for joining to a companion joining mechanism on another unit of rolling stock, located at one end of said shank; and a centering structure located adjacent the other end of said shank for maintaining said coupler in an axially aligned condition with the body axis, said centering structure including a centering cavity formed in said shank other end and a centering mount attached to said body wherein said centering cavity includes a first dome-capped triangular potion and said centering mount includes a second dome-capped triangular portion, wherein said centering mount is substantially conformal with said centering cavity and said centering cavity is oversized relative to said centering mount.

2. The improved coupler structure of claim 1 wherein said centering mount is constructed and arranged to be a relatively floating structure within said centering cavity, and which further includes a biasing mechanism to maintain said axially aligned condition.

3. The improved coupler structure of claim 1 wherein the first dome-capped triangular portion includes an arcuate surface, and the second dome-capped triangular portion includes an arcuate surface, and the arcuate surface on said second dome-capped portion has a radius which is less than the radius of the arcuate surface on said first dome-capped portion, and wherein the center of the first dome-capped portion arcuate surface radius is offset from that of said second dome-capped portion arcuate surface radius.

4. The improved coupler structure of claim 1 wherein said dome-capped triangular portions each include an arcuate working surface, and wherein a spring-receiving notch extends from said arcuate working surface of said centering cavity and a spring-receiving notch is formed in said arcuate working surface of said centering mount.

5. The improved coupler structure of claim 1 wherein said shank includes a shank element having said joining mechanism attached thereto, a shank extension, and an additional centering structure interposed between said shank element and said shank extension whereby said shank element is attached to said shank extension and centered relative thereto.

6. The coupler structure of claim 5 wherein the angular motion of said shank extension relative to the rolling stock body is about a first vertical axis, and the angular motion of said shank first portion relative to the body is about a second vertical axis which is spaced apart from said first vertical axis.

7. An improved coupler structure for use on model railroad rolling stock, which rolls on trucks attached thereto, wherein the rolling stock has a body, having a body axis thereto, comprising:

a coupler having a shank;

a joining mechanism, for joining to a companion joining mechanism on another unit of rolling stock, located at one end of said shank; and a centering structure located adjacent the other end of said shank for maintaining said coupler in an axially aligned condition with the body axis, said centering structure including a centering cavity formed in said shank other end and a centering mount attached to said body, wherein said centering structure includes substantially conformal plural working surfaces, said working surfaces including a pair of rectilinear surfaces, which join at an angle, and a curvilinear surface which intersects each of the rectilinear surfaces and wherein said working surfaces of said centering mount form laterally spaced double fulcrums at the intersections of said curvilinear surface with said rectilinear surfaces.

8. The improved coupler structure of claim 7 wherein said rectilinear surfaces are of substantially equal length.

9. The improved coupler structure of claim 7 wherein said centering cavity curvilinear surface includes a spring-receiving notch which extends therefrom and a spring-receiving notch is formed in said curvilinear surface of said centering mount.

10. The improved coupler structure of claim 7 wherein said shank includes a shank element having said joining mechanism attached thereto, a shank extension, and an additional centering structure interposed between said shank element and said shank extension whereby said shank element is attached to said shank extension and centered relative thereto.

11. The coupler structure of claim 10 wherein the angular motion of said shank extension relative to the rolling stock body is about a first vertical axis, and the angular motion of said shank first portion relative to the body is about a second vertical axis which is spaced from said first vertical axis.

12. An improved coupler structure for use on model railroad rolling stock, which rolls on trucks attached thereto, wherein the rolling stock has a body, having a body axis thereon, comprising:

a coupler having a shank;

a joining mechanism, for joining to a companion joining mechanism on another unit of rolling stock, located at one end of said shank; and a centering structure located adjacent the other end of said shank for maintaining said coupler in an axially aligned condition with the body axis, said centering structure including a centering cavity formed in said shank other end and a centering mount attached to said body, wherein the outer perimeter of said centering mount includes an arcuate side, a first straight side intersecting with said arcuate side to form a first pivot point, and a second straight side intersecting with said arcuate side to form a second pivot point, and wherein said coupler shank is pivotable relative to the rolling stock body in a first direction about said first pivot point and in an opposite second direction about said second pivot point.

13. The coupler structure of claim 12 wherein said centering cavity includes an arcuate side corresponding to said arcuate side of said centering mount, and wherein the angular motion of said shank caused by said pivoting is limited when said arcuate side of said centering mount contacts the corresponding arcuate side of said centering cavity.

14. The improved coupler structure of claim 13 wherein said first straight side of said centering mount intersects with said second straight side of said centering mount to form a centering point, wherein said centering cavity includes corresponding straight sides, and wherein said shank is centered by forcing said straight sides of said centering mount into contact with said straight sides of said centering cavity.

15. The improved coupler structure of claim 12 wherein said centering cavity arcuate surface includes a spring-receiving notch which extends therefrom and a spring-receiving notch is formed in said arcuate surface of said centering mount.

16. The improved coupler structure of claim 12 further comprising a coupler mount mounted on said body with a second centering mechanism wherein said centering mount is attached to said body by attaching said centering mount to said coupler mount.

17. The coupler structure of claim 16 wherein the angular motion of said coupler mount relative to the rolling stock body is about a first vertical axis, and the angular motion of said shank relative to the body is about a second vertical axis which is spaced apart from said first vertical axis.

* * * * *